US006592692B2

(12) United States Patent
Cho et al.

(10) Patent No.: US 6,592,692 B2
(45) Date of Patent: Jul. 15, 2003

(54) ENERGETIC PLASTICIZER COMPRISING BIS(2,2-DINITROPROPYL) FORMAL AND BIS(2,2-DINITROPROPYL) DIFORMAL, AND PREPARATION METHOD THEREOF

(75) Inventors: Jin Rai Cho, Daejon (KR); Jin Seuk Kim, Daejon (KR); Keun Deuk Lee, Daejon (KR); Bang Sam Park, Daejon (KR)

(73) Assignee: Agency For Defense Development (KR)

( * ) Notice: Subject to any disclaimer, the term of this patent is extended or adjusted under 35 U.S.C. 154(b) by 170 days.

(21) Appl. No.: 09/808,378

(22) Filed: Mar. 14, 2001

(65) Prior Publication Data

US 2001/0030008 A1 Oct. 18, 2001

(30) Foreign Application Priority Data

Apr. 10, 2000 (KR) ..... 2000/18626

(51) Int. Cl.[7] ..... C06B 25/00
(52) U.S. Cl. ..... 149/88
(58) Field of Search ..... 149/88

(56) References Cited

U.S. PATENT DOCUMENTS 4,594,430 A 6/1986 Grakauskas et al.
4,997,499 A 3/1991 Adolph
5,449,835 A 9/1995 Hamilton et al.
5,648,556 A 7/1997 Hamilton et al.

OTHER PUBLICATIONS

US Statutory Invention Registration No. H350 (published Oct. 6, 1987) Adolph, et al.

*Primary Examiner*—John Hardee
(74) *Attorney, Agent, or Firm*—Scully, Scott, Murphy & Presser

(57) ABSTRACT

The present invention provides an energetic plasticizer comprising bis(2,2-dinitropropyl) formal and a material that keeps bis(2,2-dinitropropyl) formal from crystallizing out, wherein the material that keeps bis(2,2-dinitropropyl) formal from crystallizing out is bis(2,2-dinitropropyl) diformal. In case where BDNPDF is used to prevent BDNPF from crystallizing out, BDNPF is not crystallized even though it stands at the temperature −20° C. for more than 6 months, while its thermal and chemical properties are similar to that of conventional plasticizers. Also, by using BDNPDF, that has been considered as a unfavorable side product, as an inhibitor of crystallization, no additional process is required to remove BDNPDF. Moreover, the cost involved is lower.

2 Claims, No Drawings

ENERGETIC PLASTICIZER COMPRISING BIS(2,2-DINITROPROPYL) FORMAL AND BIS(2,2-DINITROPROPYL) DIFORMAL, AND PREPARATION METHOD THEREOF

FIELD OF THE INVENTION

The present invention relates to an energetic plasticizer used in an insensitive high performance explosive and a propellant, and a preparation method thereof.

BACKGROUND OF THE INVENTION

Bis (2,2-dinitropropyl) formal (BDNPF) is a potent plasticizer used in an insensitive high performance explosive and propellant. However, it has an inherent disadvantage that it is solid at room temperature such that it can not be independently used. Thus, as a plasticizer, an eutectic mixture of BDNPF with its homologue is used.

U.S. Pat. No. 5,648,556 disclosed a plasticizer comprising an eutectic mixture of BDNPF/A, bis(2,2-dinitropropyl) formal/acetal, in which BDNPA keeps BDNPF from crystallizing out. The plasticizer comprising an eutectic mixture of BDNPF/A has been commercially available and wildly used in an explosive and a propellant. But, it is well known that thermal/chemical stability of an acetal group in the BDNPA is lower than that of the formal group in the BDNPF.

U.S. Pat. No. 4,997,499 disclosed a 2-components mixed-formal, BDNPF and 2,2-dinitropropyl 2,2-dinitrobutyl formal (DNPBF), in which DNPBF was used as an inhibitor of crystallization of BDNPF. The 2-components mixed-formal is obtained by reacting a mixture of 2,2-dinitropropanol and 2,2-dinitrobutanol with formaldehyde, but it is also known that about 10% of bis(2,2-dinitropropyl) diformal is always produced as an unfavorable side product.

The 2-components mixed-formal is believed to be superior to the BDNPF/A in terms of the thermal and chemical properties and cost involved. Nevertheless, it has never been realized in the formulation of an explosive and a propellant. It is expected that this is resulted from the difficulty of process, additional synthesis of 2,2-dinitrobutanol, the reduction of the energy efficiency.

SUMMARY OF THE INVENTION

Therefore, an object of the present invention is to provide an improved energetic plasticizer having excellent thermal and chemical properties as well as being economic.

Another object of the present invention is to provide a method for preparing the plasticizer.

To achieve these and other advantages and in accordance with the purpose of the present invention, as embodied and broadly described herein, there is provided an energetic plasticizer comprising eutectic mixture of bis(2,2-dinitropropyl) formal (BDNPF) and bis(2,2-dinitropropyl) diformal (BDNPDF), wherein BDNPDF keeps BDNPF from crystallizing out.

DETAILED DESCRIPTION OF THE PREFERRED EMBODIMENTS

The present invention relates to an energetic plasticizer comprising eutectic mixture of bis(2,2-dinitropropyl) formal (BDNPF) and a material that keeps BDNPF from crystallizing out, wherein the material that keeps BDNPF from crystallizing out is bis(2,2-dinitropropyl) diformal (BDNPDF). More specifically, the present invention relates to an energetic plasticizer comprising eutectic mixture of BDNPF and BDNPDF, wherein the BDNPDF keeps BDNPF from crystallizing out. The amount of BDNPDF used in the energetic plasticizer is preferably in the range of 8~44% by mole, based on the mixture of BDNPF and BDNPDF. The amount of BDNPF used in the energetic plasticizer is preferably in the range of 92~56% by mole, based on the mixture of BDNPF and BDNPDF.

The plasticizer of the present invention can be achieved by suitably adjusting the amount of the formaldehyde with which 2,2-dinitropropanol is reacted to form a reaction mixture comprising BDNPF and BDNPDF. More specifically, it can be achieved by slowly adding a concentrated sulfuric acid solution to a solution in which 2,2-dinitropropanol and 1~3 equivalent of paraformaldehyde or s-trioxane is dissolved in methylene chloride, wherein the methylene chloride solution is maintained at a temperature of −30~20° C., extracting mixed formals from the obtained reaction mixture, and purifying the mixed formals.

Reaction of 2,2-dinitropropanol with formaldehyde is shown in scheme 1:

Scheme 1

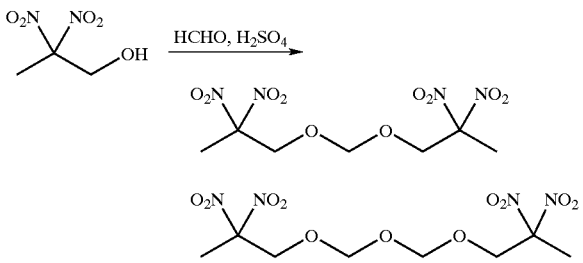

The plasticizer of the present invention in which BDNPDF prevents BDNPF from crystallizing out is not crystallized even though it stands at the temperature −20° C. for more than 6 months, while its thermal and chemical properties are similar to that of conventional plasticizer. Also, by using BDNPDF, that has been considered as a by-product, as an inhibitor of crystallization, no additional process is required to remove BDNPDF. Moreover, the cost involved is lower.

EXAMPLES

The following Examples are offered to further illustrate the present invention, but the scope of the invention is not limited thereto.

Example 1

To a stirred solution of 15 g (0.1 mole) of 2,2-dinitropropanol and 1.5 g (0.05 mole) of s-trioxane in 13 mL of methylene chloride at 0° C., 15 g (98%) of a concentrated sulfuric acid solution was injected with syringe pump over 2 hours. During the reaction, temperature was controlled not to exceed 5° C. After addition was completed, the reaction was stirred for further 30 minutes. Upon completion of the reaction, the reaction solution was quenched with water. The reaction mixture was extracted with 130 mL of methylene chloride, and then, the extract was successively washed with 5% sodium hydroxide aqueous solution (130 mL×4) and saturated sodium chloride aqueous solution (130 mL×2), dried over anhydrous magnesium sulfate, and then filtered.

The filtrate was concentrated under reduced pressure. Further evaporation under 60° C., about 10 mmHg for 5 hours gave 12.8 g of BDNPF.

The amount of BDNPDF contained in the mixed formals: 9.1.mol %

Yield: 87.0%, when diformal is considered, 86.3%

Example 2

1.5 g (0.05 mole) of s-trioxane was dissolved in 15 g (98%) of a concentrated sulfuric acid solution. The obtained solution was injected with syringe pump over 4 hours to a stirred solution of 15 g (0.1 mole) of 2,2-dinitropropanol in 13 mL of methylene chloride at 0° C. The remaining procedure was performed in the same manner as described in Example 1.

The amount of BDNPF obtained: 12.9 g

The amount of diformal contained in the mixed formals: 8 mol %

Yield: 88.0%, when diformal is considered, 87.4%

Example 3

In the same manner as described in Example 1, procedures were performed except that 1.96 g (0.065 mole) of s-trioxane was used instead of 1.5 g of s-trioxane The amount of mixed formals obtained: 13.3 g The amount of diformal contained in the mixed formals: 22.1 mol %

Yield: 90.9%, when diformal is considered, 88.6%

Example 4

In the same manner as described in Example 1, procedures were performed except that 2.25 g (0.075 mole) of s-trioxane was used instead of 1.5 g of s-trioxane The amount of mixed formals obtained: 13.4 g The amount of diformal contained in the mixed formals: 32.7 mol %

Yield: 91.9%, when diformal is considered, 89.6%

Example 5

In the same manner as described in Example 1, procedures were performed except that 3.0 g (0.10 mole) of s-trioxane was used instead of 1.5 g of s-trioxane The amount of mixed formals obtained: 13.7 g The amount of diformal contained in the mixed formals: 43.7 mol %

Yield: 93.4%, when diformal is considered, 89.2%

Example 6

In order to figure out the crystallization property of the plasticizer comprising BDNPF and BDNPDF in which BDNPDF is used as an inhibitor of crystallization of BDNPF, the eutectic mixtures obtained by the Examples 1–5 stood at a low temperature. The results showed that the eutectic mixtures were not crystallized even though it stood at a temperature of −20° C. even for more than 6 months.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. An energetic plasticizer comprising bis(2,2-dinitropropyl) formal and a material that keeps bis(2,2-dinitropropyl) formal from crystallizing out, wherein the material that keeps bis(2,2-dinitropropyl) formal from crystallizing out is bis(2,2-dinitropropyl) diformal in the amount of 8 to 44 mole % based on the mixture of bis(2,2-dinitropropyl) formal and bis(2,2-dinitropropyl) diformal.

2. A method for preparing an energetic plasticizer comprising bis(2,2-dinitropropyl) formal and bis(2,2-dinitropropyl) diformal, said bis(2,2-dinitropropyl) diformal being present in the amount of 8 to 44 mole % based on the mixture of bis(2,2-dinitropropyl) formal and bis(2,2-dinitropropyl) diformal, said method comprising:

a) slowly adding a concentrated sulfuric acid solution to a solution in which 2,2-dinitropropanol and 1 to 3 equivalent of paraformaldehyde or s-trioxane is dissolved in methylene chloride, wherein the methylene chloride solution is maintained at a temperature of −30 to 20° C.;

b) extracting mixed formals from the obtained reaction mixture; and c) purifying the mixed formals.

* * * * *